US005568973A

United States Patent [19]

Gorab

[11] Patent Number: 5,568,973

[45] Date of Patent: Oct. 29, 1996

[54] ANTIFOAM BEVERAGE STIRRER OR STRAW

[76] Inventor: Glenn N. Gorab, 817 Peachtree La., Franklin Lakes, N.J. 07417

[21] Appl. No.: 334,390

[22] Filed: Nov. 3, 1994

[51] Int. Cl.[6] ..... B01F 17/54; A47G 21/18; B65D 77/24; B06D 77/28

[52] U.S. Cl. ..... 366/129; 366/241; 366/342; 366/348; 366/349

[58] Field of Search ..... 366/129, 241, 366/279, 342, 343, 349, 348; 426/329, 85, 86, 91; 239/33

[56] References Cited

U.S. PATENT DOCUMENTS

| | | | |
|---|---|---|---|
| 3,252,803 | 5/1966 | Belasco | 426/86 |
| 3,620,770 | 11/1971 | Harvey | 426/85 |
| 3,983,251 | 9/1976 | Singh | 426/329 |
| 4,924,444 | 5/1990 | Castellanos | 366/343 |
| 5,094,861 | 3/1992 | D'Auguste et al. | 426/85 |
| 5,096,721 | 3/1992 | Levy | 426/66 |
| 5,316,779 | 5/1994 | Morey | 426/329 |

*Primary Examiner*—David Scherbel
*Assistant Examiner*—Tony G. Soohoo
*Attorney, Agent, or Firm*—Richard T. Laughlin, Esq.; Graham, Curtin & Sheridan

[57] ABSTRACT

An antifoaming agent is deposited on a stirring or straw element to be placed in a beverage receptacle. The disposition of this material on the element speeds up the pouring process and is useful in high volume environments, such as airliners, convenience stores, and college bars. The preferred material for the antifoam coating is DOW CORNING® Antifoam FG-10, which is a ten percent active, food grade silicone emulsion.

14 Claims, 1 Drawing Sheet

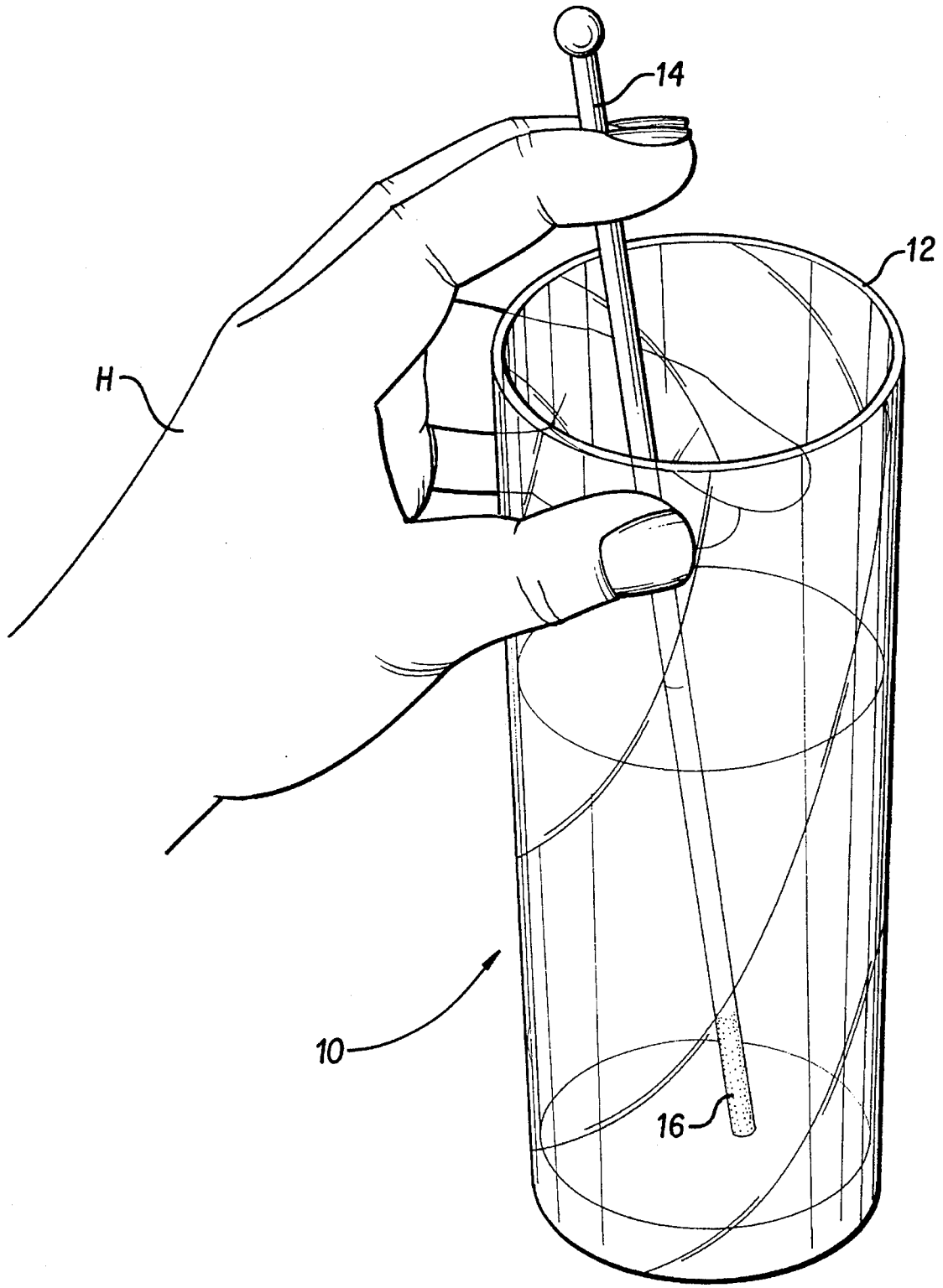
14
12
H
10
16

ANTIFOAM BEVERAGE STIRRER OR STRAW

BACKGROUND OF THE INVENTION

1. Field of the Invention

The present invention relates to beverage dispensing. More specifically, it relates to a coating treatment for a straw or beverage stirrer. Even more specifically, it relates to the coating of a straw or beverage stirrer with a silicone antifoaming agent. More generally, the invention relates to any application wherein the foaming of a liquid that is being poured into a container is not desired or needs to be discouraged. For example, the invention could be used in a food processing container or a fermentation vat by applying the agent to an agitator before the material to be used is introduced.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

In busy food service establishments, bars, and especially in an airliner environment, the server is often forced to wait for the foaming of carbonated beverages to subside before either continuing to decant the beverage or passing the customer the drink. This results in a large amount of "down time" where the employee is merely standing there looking at a fizzing glass. This is irritating for both the customer and the server, let alone the owner when there are clients waiting to be served. Additionally, the foaming liquid can overflow the glass, soiling the customers or servers clothing. Thus, it is clear that an apparatus for retarding the foaming of a carbonated beverage would be advantageous for both the owner of the restaurant, bar, or airline, but would also be a boon to the customer as well. The present invention addresses this problem by providing a straw or stirrer that has coated on a portion thereof a silicone antifoaming agent. This allows for the placement of the coated object in the glass that is to be filled, and as the beverage is poured, the antifoaming agent is dispersed in the liquid. A search was conducted in the United States Patent and Trademark Office and a number of patents were uncovered that relate to the instant invention.

Firstly, U.S. Pat. No. 2,613,988, issued on Oct. 14, 1952 to Charles F. Jarbeau discloses a beverage dispensing device. In this device, a straw or sipper made up of two telescopically engaged sections is placed inside a bottle. The upper portion is made of a material such that its specific gravity is less than the beverage, and the lower portion has a specific gravity higher than the beverage so that when the cap is removed, the upper portion rises to allow the user to drink from the bottle. This is clearly dissimilar from the present invention in that there is no mention of an antifoaming agent.

Next is U.S. Pat. No. 3,947,568, issued on Mar. 30, 1976 to Barstow Bates et al. This discloses a cosmetic composition that includes liquefied gasses entrained within a liquid stream under pressure. Though the disclosure discusses the use of a silicone antifoaming material as part of the composition, this patent does not discuss the coating of an object to be placed within a beverage receptacle as is required by the present invention.

Another patent of interest is U.S. Pat. No. 4,037,361, issued on Jul. 26, 1977 to William R. Murphy et al. This discloses a hollow, flexible plant watering stick with a funnel shaped opening at the top surmounted by a decorative cap. This is clearly dissimilar from the present invention in that no antifoaming agent is taught for coating the stick.

Lastly, U.S. Pat. No. 4,726,518, issued on Feb. 23, 1988 to Emanuela Martina et al. discloses a straw with a plurality of channels passing about a flattened portion designed for advertising or the like. As in the above mentioned patent, there is no teaching of an antifoaming agent for coating of the portion of the straw that is to be inserted into the beverage.

It will be noted that none of the prior art devices teaches an antifoaming agent coating on a straw or stirring device to prevent the foaming of carbonated liquids.

SUMMARY OF THE INVENTION

Briefly, the invention comprises a coating of an antifoaming agent deposited on a stirring or straw element that is to be placed in a carbonated beverage receptacle. The disposition of this material on the object speeds up the pouring process and is useful in high volume environments, such as airliners, convenience stores, and college bars. The preferred material for the coating is DOW CORNING® Antifoam FG-10, which is a ten percent active, food grade silicon emulsion.

Accordingly, it is a principal object of the invention to provide a new and improved beverage stirrer or straw device which overcomes the disadvantages of the prior art in a simple but effective manner.

It is another object of the invention to prevent overflow spillage onto customers servers clothing from the foaming liquid.

It is a major object of this invention to provide a stirrer or straw that speeds up the pouring process of a carbonated beverage, by inhibiting the foaming of the beverage as it is being poured.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawing, in which like reference characters designate the same or similar parts throughout the view, and wherein:

The FIGURE shown is an environmental perspective view of the present invention in use.

DETAILED DESCRIPTION OF THE PREFERRED EMBODIMENTS

The present invention is shown in the FIGURE at 10. The stirrer, straw, or "swizzle stick" is indicated at 14 placed in a glass 12. A portion of the stirrer 14 is coated with an antifoaming agent. The portion of the stirrer or straw 14 that is coated with the agent is indicated by the stippled area 16. Thus, the user, whose hand H is seen in the FIGURE, places the stirrer, straw, or other like object treated according to the present invention, in the glass 12 and then fills glass 12 with the carbonated liquid and the coating 16 on the stirrer or straw is dissipated through the liquid to lessen the amount of foam generated during the pouring process. Thus, the person pouring the drink is not required to wait for the foam to subside before topping off the glass or handing the beverage to the customer, airline passenger, or the like. It should be noted that the stirrer shown in the FIGURE is of a solid type, it would be within the scope of the present invention to coat the outside of a hollow member, i.e. a straw, with the same material.

As was mentioned previously, the preferred antifoaming ingredient for the application of the invention is Antifoam FG-10 manufactured by DOW CORNING® based in Midland, Mich. This is a food grade antifoam silicone emulsion that complies with FDA Regulation 21 CFR 173.340, is permitted as a component of paper that would be brought into contact with foodstuffs, and is authorized by the USDA for use in federally inspected meat and poultry plants. The agent has also been certified for use in processing of kosher foods.

The inventor has found that this material, applied directly to a straw or a stirring stick, substantially eliminates a large portion of the foaming that is normally present when a carbonated beverage is poured into a glass, speeding up the serving process. As the preferred material is concentrated, only a small portion of the straw or stirrer needs be coated.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily adapt the invention to a usage where the stirring member was machine driven, as opposed to the hand manipulable object depicted in the drawing.

It is to be understood that the present invention is not limited to the sole embodiment described above, but encompasses any and all embodiments within the scope of the following claims:

I claim:

1. A stirrer for utilization in combination with a container for receiving and dispensing foaming liquids comprising a stirrer having on at least part of its surface an antifoaming agent which will reduce the surface tension of the liquid in the container when placed in the container prior to filling the container with the foaming liquid and will substantially reduce the amount of time required for pouring the foaming liquid into the container by reducing the amount of foam produced.

2. The improvement as defined in claim 1, wherein said stirrer is coated over less than 50% of the total area of said stirrer with the antifoaming agent.

3. The improvement as claimed in claim 2, wherein said coating comprises a silicone emulsion.

4. The improvement as defined in claim 1, wherein said antifoaming agent is silicone applied as an emulsion coating.

5. The improvement as defined in claim 1, wherein said stirrer is a substantially hollow straw.

6. The improvement as defined in claim 5, wherein said stirrer is coated over less than 50% of the total area of said stirrer.

7. The improvement as claimed in claim 6, wherein said coating comprises a silicone emulsion.

8. In the combination of a drinking glass or similar container for receiving, holding and dispensing a carbonated foaming liquid to an individual, and a stirrer with a portion thereof extending into the container, the improvement which comprises a food grade antifoaming agent on at least part of the outer surface of said portion to inhibit the formation of foam on the portion of the liquid in the container by reducing the surface tension of the liquid in the container.

9. A stirring stick for a beverage container comprising a stick of a length suitable for stirring liquid in a beverage container for receiving and dispensing a foaming liquid;

a food-grade antifoaming agent disposed on a part of the surface of the stick to be immersed in the foaming liquid, wherein the food-grade antifoaming agent will reduce the surface tension of the liquid in the beverage container when placed into the beverage container and will substantially reduce the time required for pouring the foaming liquid into the beverage container by reducing the amount of foam produced.

10. The stirring stick according to claim 9, wherein the stick is a substantially hollow straw.

11. The stirring stick according to claim 10, wherein the food-grade antifoaming agent is a food-grade antifoam silicone emulsion complying with FDA Regulation 21 CFR 173.340;

and wherein the hollow straw is coated with antifoaming agent over less than half of the outer surface near an end to be immersed into the liquid.

12. In the method of pouring a carbonated foaming liquid into a drinking glass or similar container and then dispensing the carbonated or foaming liquid in the container to an individual, the improvement which comprises reducing the amount of foaming of the liquid in the container and the time required to fill the container with the liquid, coating a stirrer with a food grade antifoaming agent for reducing the surface tension of the liquid in the container, on at least part of the outer surface of the stirrer, and placing a portion of the stirrer containing said coating at least partially into the container prior to the introduction of the foaming liquid into the container.

13. A method of pouring a carbonated foaming liquid into a drinking container comprising coating a stirring stick for a beverage container over a part of its surface near an end to be immersed into a liquid with a food-grade antifoaming agent for reducing the surface tension of a carbonated foaming liquid in contact with the food-grade antifoaming agent;

placing the stirring stick into a beverage container with the coated area of the stirring stick being located near a bottom of the beverage container;

dispensing the carbonated foaming liquid into the beverage container;

decreasing foam formation in the carbonated foaming liquid with the food-grade antifoaming agent upon contact between the carbonated foaming liquid with the food-grade antifoaming agent disposed on the stirring stick by reducing the surface tension of the carbonated foaming liquid.

14. The method according to claim 13, further comprising reducing the weight of the stirring stick by employing a substantially hollow straw as a stirring stick;

safeguarding the health of the consumer of the carbonated foaming liquid by employing a food-grade antifoam silicone emulsion complying with FDA Regulation 21 CFR 173.340 as a food-grade antifoaming agent; and restricting the surface area of the hollow straw coated with antifoaming agent to less than one-half of the outer surface near the end of the hollow straw to be immersed into the liquid.

* * * * *